United States Patent [19]

Rangwala et al.

[11] Patent Number: 4,895,193

[45] Date of Patent: Jan. 23, 1990

[54] CONTAINER FILLING SYSTEM

[75] Inventors: Badruddin K. Rangwala, Farmington Hills; Kenneth P. McDonald, Livonia, both of Mich.

[73] Assignee: Elopak Systems A.G., Glattbrug, Switzerland

[21] Appl. No.: 257,845

[22] Filed: Oct. 14, 1988

[51] Int. Cl.[4] ..... B67C 3/20; B67D 5/30

[52] U.S. Cl. ..... 141/9; 141/103; 141/128; 141/83; 53/563

[58] Field of Search ..... 53/563; 141/1, 9, 100, 141/128, 83

[56] References Cited

U.S. PATENT DOCUMENTS

| | | | |
|---|---|---|---|
| 2,328,372 | 8/1943 | Wollenweber | 141/103 X |
| 2,548,222 | 4/1951 | Kindseth | 141/103 |
| 3,702,625 | 11/1972 | Schmidt | 141/1 |
| 3,789,746 | 2/1974 | Martensson et al. | 53/563 |
| 4,458,735 | 7/1984 | Houman | 141/95 |
| 4,604,850 | 8/1986 | Reil | 53/563 X |

FOREIGN PATENT DOCUMENTS

| | | | |
|---|---|---|---|
| 2534554 | 2/1977 | Fed. Rep. of Germany | 141/103 |
| 2921663 | 12/1980 | Fed. Rep. of Germany | 141/95 |

*Primary Examiner*—Ernest G. Cusick
*Attorney, Agent, or Firm*—John P. Moran

[57] ABSTRACT

A container filling system on an indexing, forming, filling and sealing machine, wherein each successive container is progressively filled with variable volumes of a fluid, such as milk, in a manner which minimizes the foam build-up therein, thereby enhancing leak-proof top sealing characteristics during high production operations. The containers are filled in accordance with the following filling sequence formula:

$$V_t = \sum_{i=1}^{n} V_i = V_1 + V_2 + V_3 \ldots + V_n$$

$$V_i = \frac{V_t}{2n^2}[n + 2i - 1]$$

wherein:
$V_t$=total carton volume
$V_i$=volume delivered at i station
i=station number
n=number of stations.

6 Claims, 1 Drawing Sheet

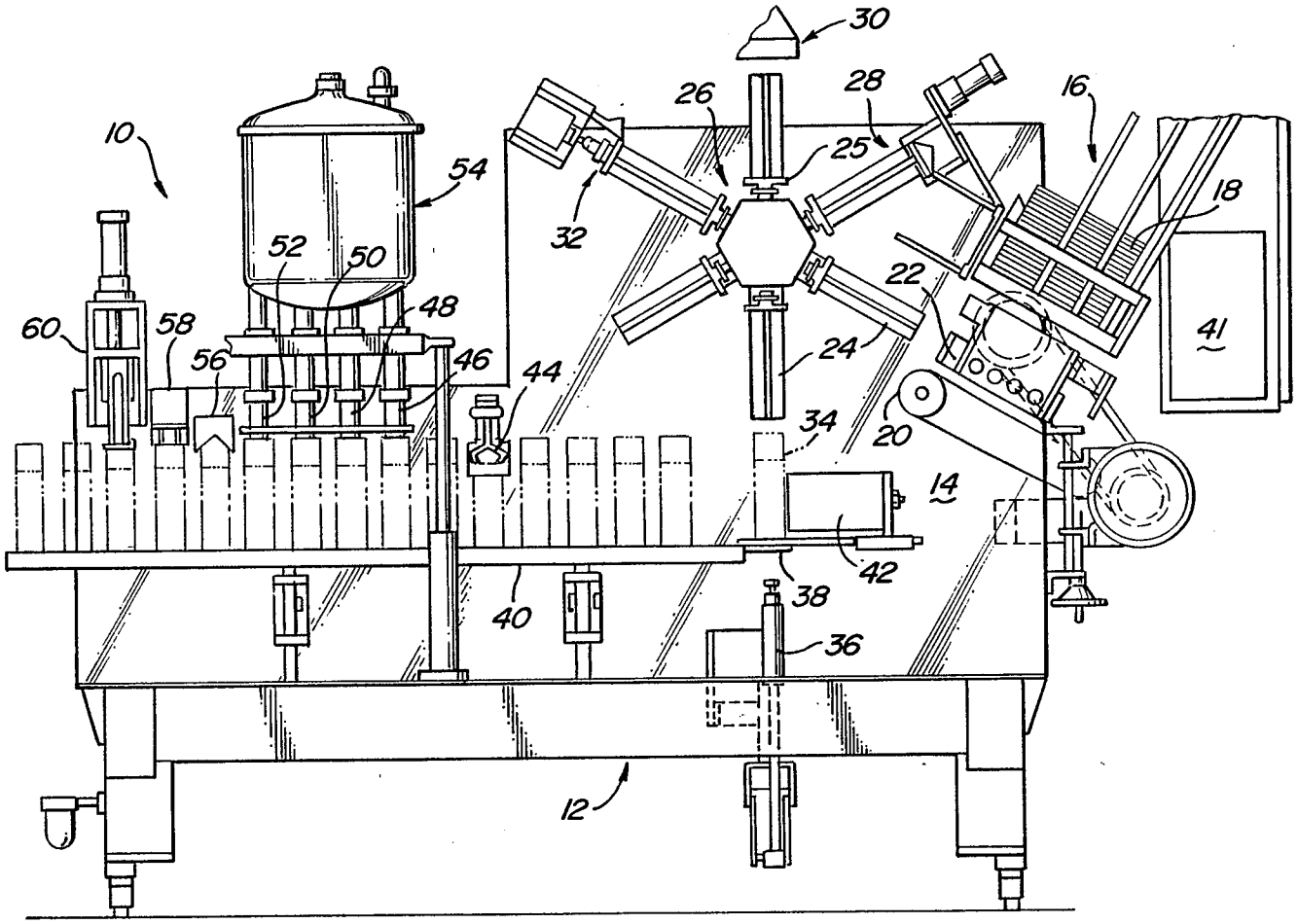
10
12
14
16
18
20
22
24
25
26
28
30
32
34
36
38
40
41
42
44
46
48
50
52
54
56
58
60

CONTAINER FILLING SYSTEM

TECHNICAL FIELD

This invention relates generally to filling systems for containers and, more particularly, to variable volume progressive filling systems.

BACKGROUND ART

Heretofore, on constant speed indexing machines, it has been customary to progressively fill larger size containers with equal partial volumes of fluid at each of a number of stations, e.g., four fills of 16 ounces at each of four successive stations for a 64 ounce container. Such a process has resulted in the presence of an excessive volume of foam in the headspace of the container after the last station, requiring a separate defoaming apparatus after the last filling step before successful top sealing can be accomplished.

DISCLOSURE OF THE INVENTION

A general object of the invention is to provide an improved container filling system wherein the volume of resulting foam is minimal.

Another object of the invention is to provide a progressive container filling system wherein variable volumes of a fluid, such as milk, are dispensed into a container to better control the amount of resultant foam when the container if filled.

A further object of the invention is to provide a progressive container filling system wherein partial volumes of fluid are dispensed into the container at each of a predetermined number of stations substantially in accordance with an ideal distribution formula.

These and other objects and advantages of the invention will become more apparent when reference is made to the following description and accompanying drawings.

BRIEF DESCRIPTION OF THE DRAWINGS

The FIGURE is a side elevational view of a container filling machine embodying the invention.

BEST MODE OF CARRYING OUT THE INVENTION

Referring now to the drawing in greater detail, there is illustrated a forming, filling and sealing machine 10 of the liquid packaging type, including a base frame 12 and a vertical support keel 14. A magazine 16 for holding a plurality of paperboard blanks 18 is mounted on one end of the keel 14. A loading mechanism 20 is mounted on the keel just below the magazine 16 and adapted to withdraw one blank at a time from the magazine while opening same into a four-sided tube 22 and then to load the individual tube onto one of six mandrels 24 of an indexable turret mechanism 26 in approximately the 4:00 o'clock position. An adjustable stop member 25 is operatively connected to each mandrel 24 to accommodate the forming of containers having the same cross-section but different heights.

As the mandrel indexes counterclockwise, each tube 22 passes by a prebreaker unit 28, a heater 30, and a closing and sealing unit 32, to an unloading 6:00 o'clock position. At the latter position, each bottom-sealed container, represented at 34, is stripped from the mandrel 24 by a stripping unit 36, and placed on a stationary rail 38 adjacent a pair of parallel endless conveyors 40 whose indexing sequence is coordinated with that of the turret mechanism 26 through suitable cam means (not shown).

A transfer pusher 42 moves each open-topped container 34 from the rail 38 into suitable pockets (not shown) on the conveyor 40. After a predetermined number of indexes of the conveyor, each successive container 34 is typically positioned beneath a top prebreaker unit 44.

Each container 34 is thereafter progressively indexed at a constant indexing speed into position beneath four filling units 46, 48, 50 and 52 in series. Controlled by suitable panel means 41, each unit feeds a measured volume of a particular liquid, such as milk, from a source 54 into each successive container. After passing by the last filler unit 52, the container tops are folded, heated, and sealed by respective folding, heating, and sealing units 56, 58 and 60.

The filling units 46, 48, 50 and 52 may contain either four respective different sized pistons, all with the same stroke length, or constant piston size with different stroke lengths, so as to dispense variable volumes of the fluid into each container 34 being indexed therepast, in accordance with the following formula:

$$V_t = \sum_{i=1}^{n} V_i = V_1 + V_2 + V_3 \ldots + V_n$$

$$V_i = \frac{V_t}{2n^2}[n + 2i - 1]$$

wherein:

$V_t$=total carton volume $V_i$=volume delivered at i station i=station number n=number of stations For example, to fill a 64 ounce container over four successive stations, in lieu of dispensing 16 ounces at each station 46, 48, 50 and 52, as has heretofore been the customary approach, the application of the above filling sequence formula would produce the following result:

$$V_i = \frac{64}{2 \times 4^2} 4 + [(2 \times 1) - 1] = 10 \text{ ounces}$$

$$V_2 = 2 \quad [4 + 4 - 1] = 14 \text{ ounces}$$

$$v_3 = 2 \quad [4 + 6 - 1] = 18 \text{ ounces}$$

$$v_4 = 2 \quad [4 + 8 - 1] = 22 \text{ ounces}$$

Total 64 ounces

In situations where the formula produces individual station volumes in other than whole numbers, such results may generally be rounded off to the nearest whole number for facilitating the designing or selecting of the individual cylinders and their pistons. For example, to fill a 32 ounce container over three successive stations, such as beneath the filler units 46, 48 and 50 only, the application of the filling sequence formula would produce the following result:

$$V_1 = \frac{32}{2 \times 3^2}[3 + (2 \times 1) - 1] = \frac{32}{18} \times 4 = 7.111 \text{ or } 7 \text{ ounces}$$

$$V_2 = \frac{32}{18}[3 = (2 \times 2) - 1] = \frac{32}{18} \times 6 = 10.667 \text{ or } 11 \text{ ounces}$$

$$V_3 = \frac{32}{18}[3 + (2 \times 3) - 1] = \frac{32}{18} \times 8 = 14.222 \text{ or } 14 \text{ ounces}$$

Total 32 ounces

Tests have shown that containers filed in accordance with the above filling sequence formula have reduced the final foam volume substantially, eliminating the need for a defoaming operation between the last filler unit 52 and the top sealing unit 60.

INDUSTRIAL APPLICABILITY

It should be apparent that the invention provides a container filling system wherein foam is reduced to the point that there is minimal foam interference in the headspace of each container, such that the top sealing operation may be effectively and thoroughly completed in a manner which prevents subsequent leakage from occurring.

It should also be apparent that, rather than varying the piston and cylinder diameter for constant stroke length, it would be possible to maintain a constant piston and cylinder diameter and vary the stroke length thereof to produce the above described progressively variable volumes at the respective stations of a constant speed indexing machine, when applying the recommended filling formula.

It should be further apparent that there may be more filling units on a particular machine than the four shown in the drawing, in conformance to the above described filling sequence formula, or that fewer than the four filling units included may be used for particular container sizes.

While but one general embodiment has been shown and described, other modifications thereof are possible within the scope of the following claims.

The embodiments of the invention in which an exclusive property or privilege is claimed are defined as follow.

1. A method of filling liquid-carrying containers on a forming, filling, and sealing indexing machine, comprising the steps of dispensing a predetermined progressively larger volume of fluid into each container at each of a predetermined number of stations to fill each container with a resultant minimal amount of foam in the headspace thereof.

2. A method of filling liquid-carrying containers on a forming, filling and sealing indexing machine, said method comprising the steps of progressively filling each container at each of a predetermined number of stations with respective volumes of fluid in accordance with the following formula:

$$V_t = \sum_{i=1}^{n} V_i = V_1 + V_2 + V_3 \ldots + V_n$$

$$V_i = \frac{V_t}{2n^2}[n + 2i - 1]$$

wherein:

$V_t$=total carton volume $V_i$=volume delivered at i station i=station number

N=number of stations

3. The method described in claim 2, wherein the containers are conveyed from one filler unit to the next at a constant indexing speed.

4. The method described in claim 3, wherein the respective filler units vary in piston and cylinder size while all are actuated through the same stroke length.

5. The method described in claim 3 wherein the respective filler units are the same cylinder and piston size, but varied in the lengths of their respective dispensing strokes.

6. The method described in claim 2, wherein less than said predetermined number of stations may be actuated for particular applications involving different container sizes.

* * * * *